US011953017B1

(12) United States Patent
Chen et al.

(10) Patent No.: US 11,953,017 B1
(45) Date of Patent: Apr. 9, 2024

(54) HAND-HELD FAN

(71) Applicant: Shenzhen Qianhai Weilisheng Network Co., Ltd, Shenzhen (CN)

(72) Inventors: Xiongbin Chen, Shenzhen (CN); Xiongjian Chen, Guangzhou (CN)

( * ) Notice: Subject to any disclaimer, the term of this patent is extended or adjusted under 35 U.S.C. 154(b) by 0 days.

(21) Appl. No.: 18/484,239

(22) Filed: Oct. 10, 2023

(30) Foreign Application Priority Data

Aug. 23, 2023 (CN) ..... 202322281714.1

(51) Int. Cl.
*F04D 25/08* (2006.01)
*F04D 25/06* (2006.01)
*F04D 29/70* (2006.01)

(52) U.S. Cl.
CPC ..... *F04D 25/084* (2013.01); *F04D 25/0673* (2013.01); *F04D 29/703* (2013.01)

(58) Field of Classification Search
CPC .. F04D 19/002; F04D 25/0673; F04D 25/084; F04D 29/524; F04D 29/703
See application file for complete search history.

(56) References Cited

U.S. PATENT DOCUMENTS

| | | | | |
|---|---|---|---|---|
| 5,720,594 | A | 2/1998 | Snow | |
| 10,836,027 | B2 * | 11/2020 | Yang | B24B 23/028 |
| 2004/0184935 | A1 | 9/2004 | Wang | |
| 2013/0034453 | A1 | 2/2013 | Kojima et al. | |
| 2013/0094980 | A1 * | 4/2013 | Chan | F04D 25/084 417/423.1 |
| 2017/0198703 | A1 * | 7/2017 | Leitman | H01R 35/00 |
| 2019/0075950 | A1 * | 3/2019 | Xu | A47G 21/186 |
| 2019/0338786 | A1 * | 11/2019 | Jones | F04D 25/084 |
| 2019/0351360 | A1 * | 11/2019 | Plotkin | F04D 25/084 |
| 2021/0079931 | A1 * | 3/2021 | Hu | F04D 25/084 |
| 2021/0391768 | A1 * | 12/2021 | Jang | F04D 17/16 |
| 2023/0265854 | A1 * | 8/2023 | Chen | F04D 19/002 416/63 |

FOREIGN PATENT DOCUMENTS

| | | | |
|---|---|---|---|
| CN | 205401179 U | * | 7/2016 |
| CN | 205823673 U | * | 12/2016 |
| CN | 107701473 A | * | 2/2018 |
| CN | 108691788 A | * | 10/2018 |
| CN | 207989361 U | * | 10/2018 |
| CN | 111306080 A | * | 6/2020 |

(Continued)

*Primary Examiner* — Alexander B Comley

(57) ABSTRACT

The application discloses a hand-held fan, including a main housing. The main housing includes a cylindrical holding part and a semi-cylindrical mounting part. The hand-held fan also includes a set of protection covers provided at the mounting part. The protection cover is also provided with a connecting part rotatably connected to the mounting part. An outer side of the mounting part is opened and provided with an annular slot, the connecting part is provided with a plurality of catch platforms clamped and connected to the annular slots, two limit grooves are symmetrically provided in the annular slot along a rotating axial direction of the fan blade, and the inner side of the connecting part is provided with two limit bosses clamped and connected to the two limit grooves. This application solves the problem that an existing small hand-held fan cannot effectively protect the fan blade.

9 Claims, 6 Drawing Sheets

(56) References Cited

FOREIGN PATENT DOCUMENTS

| | | | | | |
|---|---|---|---|---|---|
| CN | 210660660 | U | * | 6/2020 | |
| CN | 211259065 | U | * | 8/2020 | |
| CN | 111854022 | A | * | 10/2020 | |
| CN | 112833036 | A | * | 5/2021 | ..... B27C 5/00 |
| CN | 112983867 | A | * | 6/2021 | ..... A45D 42/00 |
| CN | 113068673 | A | * | 7/2021 | |
| CN | 114508498 | A | * | 5/2022 | |
| CN | 216812236 | U | * | 6/2022 | ..... F04D 17/06 |
| DE | 20320023 | U1 | * | 6/2004 | ..... F04D 25/084 |
| JP | 2008057519 | A | * | 3/2008 | |
| WO | WO-2008112545 | A1 | * | 9/2008 | ..... A61L 9/122 |

* cited by examiner

HAND-HELD FAN

TECHNICAL FIELD

The utility model relates to the technical field of a fan, and in particular, to a hand-held fan.

BACKGROUND

As living conditions become better and better, more and more small household appliances are favored by people. Many people like to use a hand-held fan to cool themselves down. The hand-held fan is popular due to small size and no space restrictions.

There are two types of existing hand-held fans, one is with a fan blade directly exposed to the outside, and the other is with a protection casing added to the outer side of the fan blade to prevent a user from being scratched. Regarding a second structure, because the structure of a housing is fixed, the volume of the hand-held fan needs to be made larger, which is inconvenient to carry and affects a user's experience. Regarding a first structure with an exposed fan blade, although the volume of the fan may be reduced, such a structure is not able to protect the fan blade. The fan blade is exposed externally when being carried. Therefore, it is easy for the fan blade to be damaged, affecting the service life of the fan.

SUMMARY

A main objective of the utility model is to provide a hand-held fan, aiming at solving the problem that an existing small hand-held fan cannot effectively protect a fan blade.

To achieve the above objective, the utility model proposes a hand-held fan, including a main housing. The main housing includes a cylindrical holding part and a semi-cylindrical mounting part. A fan blade for rotation is mounted at the mounting part. A motor for driving the fan blade to rotate, a battery for supplying power to the motor, and a PCB main control board for controlling the motor to be turned on/off are mounted inside the main housing. The motor and the battery are electrically connected to the PCB main control board respectively.

The hand-held fan also includes a set of protection covers provided at the mounting part. The main body of the protection cover is provided as a semi-cylindrical cover-shaped structure adapted to the mounting part. The protection cover is also provided with a connecting part rotatably connected to the mounting part. The outer side of the mounting part is opened and provided with an annular slot. The connecting part is provided with a plurality of catch platforms clamped and connected to the annular slots. Two limit grooves are symmetrically provided in the annular slot along a rotating axial direction of the fan blade. The inner side of the connecting part is provided with two limit bosses clamped and connected to the two limit grooves.

Optionally, a drive shaft of the motor extends to an outer side of the mounting part. The drive shaft is connected to a mounting member for mounting the fan blade. The mounting member includes a connecting post coaxially sleeved with the drive shaft. The connecting post is provided with a mounting plate at the end. The fan blade is mounted on the mounting plate.

Optionally, the mounting plate is provided as a circular plate. The mounting plate is provided thereon with a plurality of mounting posts for mounting the fan blade. The fan blade is fixed at the mounting post by a screw.

Optionally, the outer side of the holding part is also wrapped with a layer of heating sheet. The heating sheet is electrically connected to the PCB main control board and the battery.

Optionally, the outer side of the holding part is also sleeved with a bottom cover. The heating sheet is mounted in close proximity to the inner side of the bottom cover.

Optionally, the side of the bottom cover is provided with a first switch for controlling the working state of the motor and the heating sheet. The first switch is electrically connected to the PCB main control board.

Optionally, an LED light for illumination is also mounted at the end of the bottom cover. The LED light is electrically connected to the PCB main control board and the battery.

Optionally, the side of the bottom cover is also provided with a second switch for controlling the working state of the LED light. The second switch is electrically connected to the PCB main control board.

Optionally, the side of the bottom cover is provided with a charging interface for charging the battery. The charging interface is electrically connected to the PCB main control board.

Optionally, the side of the bottom cover is also provided with a USB interface for charging an external device. The USB interface is electrically connected to the PCB main control board.

The beneficial effect of the utility model is as follows: The structure of the existing hand-held fan is improved. One protection cover that may be movably mounted is added to the outer side of the fan blade of the fan. When the fan blade needs to be used to blow, the protection cover may be rotated and the fan blade is exposed to blow. When the fan blade does not need to be used to blow, the protection cover is rotated again to be able to hide the fan blade therein, which protects the fan blade and prevents the damage of the fan blade in a process of carrying. In addition, the main body of the hand-held fan consists of a main housing and the protection cover, which form one cylindrical structure. The hand-held fan is compact, and is convenient to use and carry, greatly enhancing the convenience of use.

BRIEF DESCRIPTION OF THE DRAWINGS

In order to explain embodiments of the utility model or the technical solutions in the prior art more clearly, the following briefly introduces the drawings that need to be used in the description of the embodiments or the prior art. Obviously, the drawings in the following description are only some of the embodiments of the utility model. The person skilled in the art may obtain other drawings based on structures shown in these drawings without creative labor.

Figure 1:
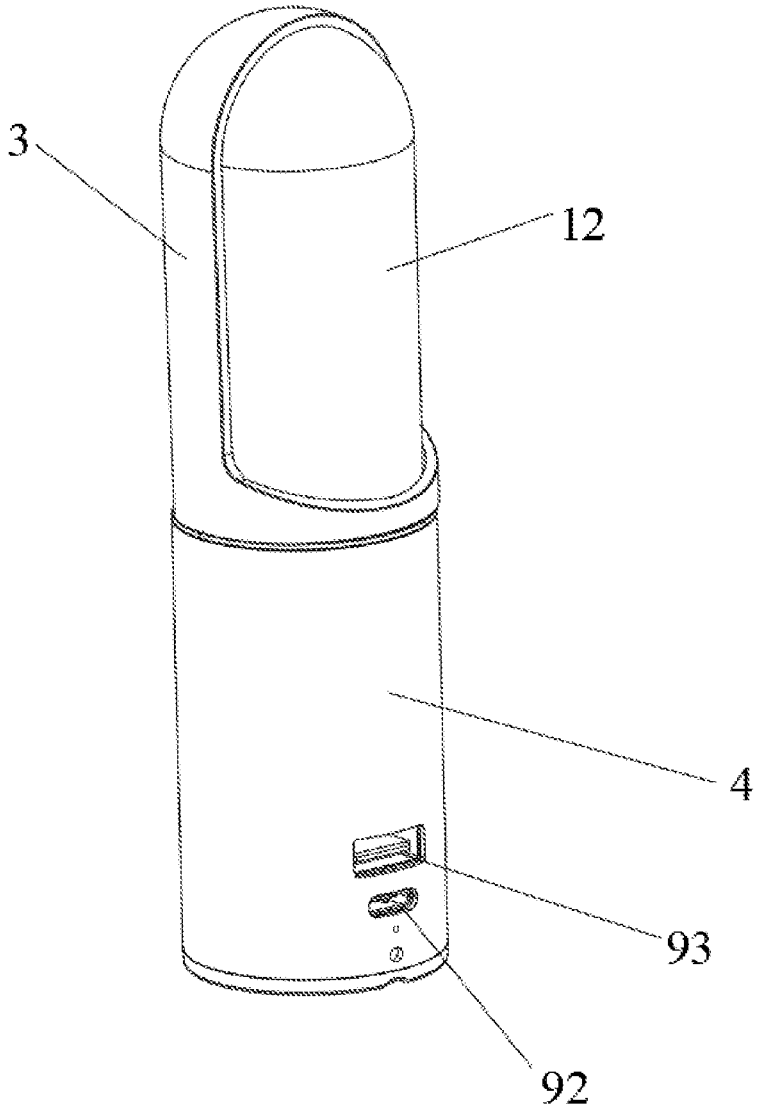
FIG. 1 is a schematic diagram of the fan structure when the protection cover of the utility model is closed.

The realization, functional characteristics and advantages of the objective of the utility model will be further described with reference to the drawings in conjunction with the embodiments.

DETAILED DESCRIPTION OF EMBODIMENTS

The following clearly and completely describes the technical solutions in embodiments of the utility model in conjunction with the drawings in the embodiments of the utility model. Obviously, the described embodiments are only a part of the embodiments of the utility model, rather than all embodiments. Based on the embodiments of the present utility model, all other embodiments obtained by a person skilled in the art without creative labor shall fall within the protection scope of the present utility model.

It should be noted that if the embodiments of the utility model involve directional indications (such as up, down, left, right, front, back . . . ), the directional indications are only used to explain a relative position relationship and movement among various components under a certain posture (as shown in the accompanying drawings). If a specific posture changes, the directional indication also changes accordingly.

In addition, if there are descriptions of terms such as "first", "second" and the like in the embodiments of the utility model, the descriptions of the terms such as "first", "second" and the like are merely intended for a purpose of description, and shall not be understood as an indication or implication of relative importance or implicit indication of a quantity of indicated technical features. Therefore, the features defined with "first" and "second" can explicitly or implicitly include at least one of the features. In addition, the meaning of "and/or" in the whole text is to include three parallel schemes. Taking "A and/or B" as an example, "A and/or B" includes scheme A, scheme B, or a scheme that A and B are satisfied at the same time. In addition, the technical solutions among the various embodiments may be combined with each other, but should be based on what may be achieved by the person skilled in the art. When a combination of technical solutions is contradictory or cannot be achieved, it should be considered that such a combination of technical solutions does not exist, and also does not fall within the scope of protection required by the utility model.

An embodiment of the utility model proposes a hand-held fan, including a main housing 1. The main housing 1 includes a cylindrical holding part 11 and a semi-cylindrical mounting part 12. A fan blade 21 for rotation is mounted at the mounting part 12. A motor 22 for driving the fan blade 21 to rotate, a battery 5 for supplying power to the motor 22, and a PCB main control board 6 for controlling the motor 22 to be turned on/off are mounted inside the main housing. The motor 22 and the battery 5 are electrically connected to the PCB main control board 6 respectively.

The hand-held fan also includes a set of protection covers 3 provided at the mounting part 12. The main body of the protection cover 3 is provided as a semi-cylindrical cover-shaped structure adapted to the mounting part 12. The protection cover 3 is also provided with a connecting part 31 rotatably connected to the mounting part 12. The outer side of the mounting part 12 is opened and provided with an annular slot 121. The connecting part 31 is provided with a plurality of catch platforms 32 clamped and connected to the annular slots 121. Two limit grooves 122 are symmetrically provided in the annular slot 121 along a rotating axial direction of the fan blade 21. The inner side of the connecting part 31 is provided with two limit bosses 33 clamped and connected to the two limit grooves 122.

It should be noted that most of the protection covers outside the fan blade of the existing hand-held fan have a grid-shaped fixed structure. The structure of the protection cover is fixed and is not removable. To ensure that the fan blade has an enough space for movement, the protection cover has a large volume, resulting in the overall large volume of the fan. Therefore, it is very inconvenient to carry. In addition, in a process of long-time use, a large amount of dust and impurities are accumulated on the fan blade. Due to fixed protection cover, the fan blade cannot be effectively cleaned up, which affects the smoothness of the rotation of the fan blade and reduces a user's experience.

Figure 2:
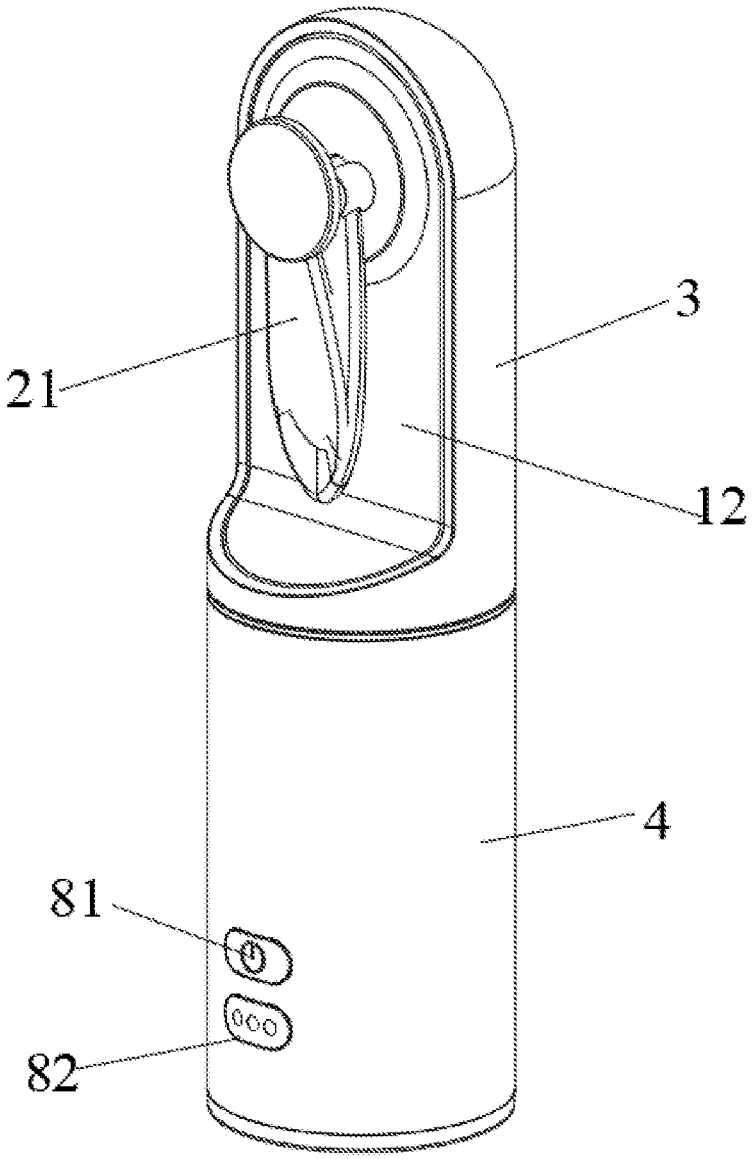
FIG. 2 is a schematic diagram of the fan structure when the protection cover of the utility model is opened.

This embodiment improves the structure of the protection cover 3 of the hand-held fan based on the defects in the above prior art. Referring to FIGS. 1 and 2, the protection cover 3 is mounted on the main housing 1 in a sliding connection manner. When the fan blade 21 needs to blow wind, the protection cover 3 is rotated, which may expose the fan blade 21 for blowing wind. When there is no need to use the fan blade 21 for blowing wind, the protection cover 3 is rotated again and may hide the fan blade 21 therein, which protects the fan blade 21 and is convenient to use. In addition, the holding part 11 of the main housing 1 adopts a cylindrical structure. The mounting part 12 adopts a semi-cylindrical structure. The protection cover 3 is sleeved on the mounting part 12 and forms one cylindrical structure with the mounting part 12, so that the fan is in the form of one cylindrical capsule-shaped structure, which has a compact volume, is convenient to carry, and improves the user's experience.

Figure 3:
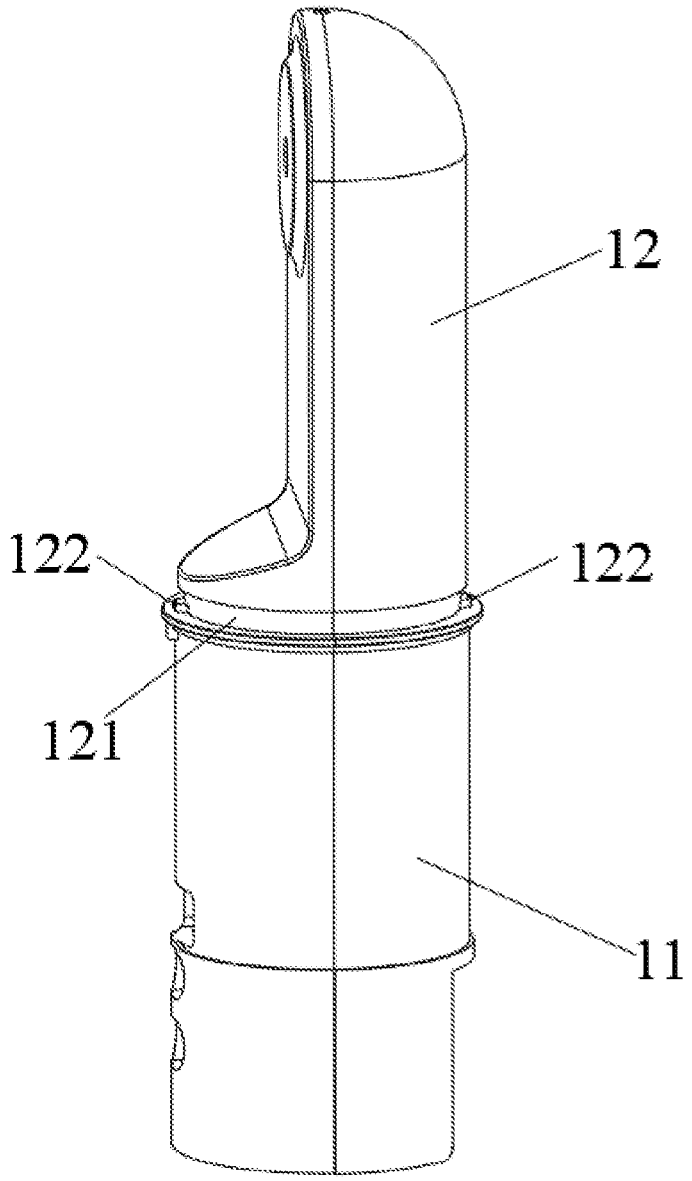
FIG. 3 is a schematic structural diagram of a main housing of the utility model.
Figure 4:
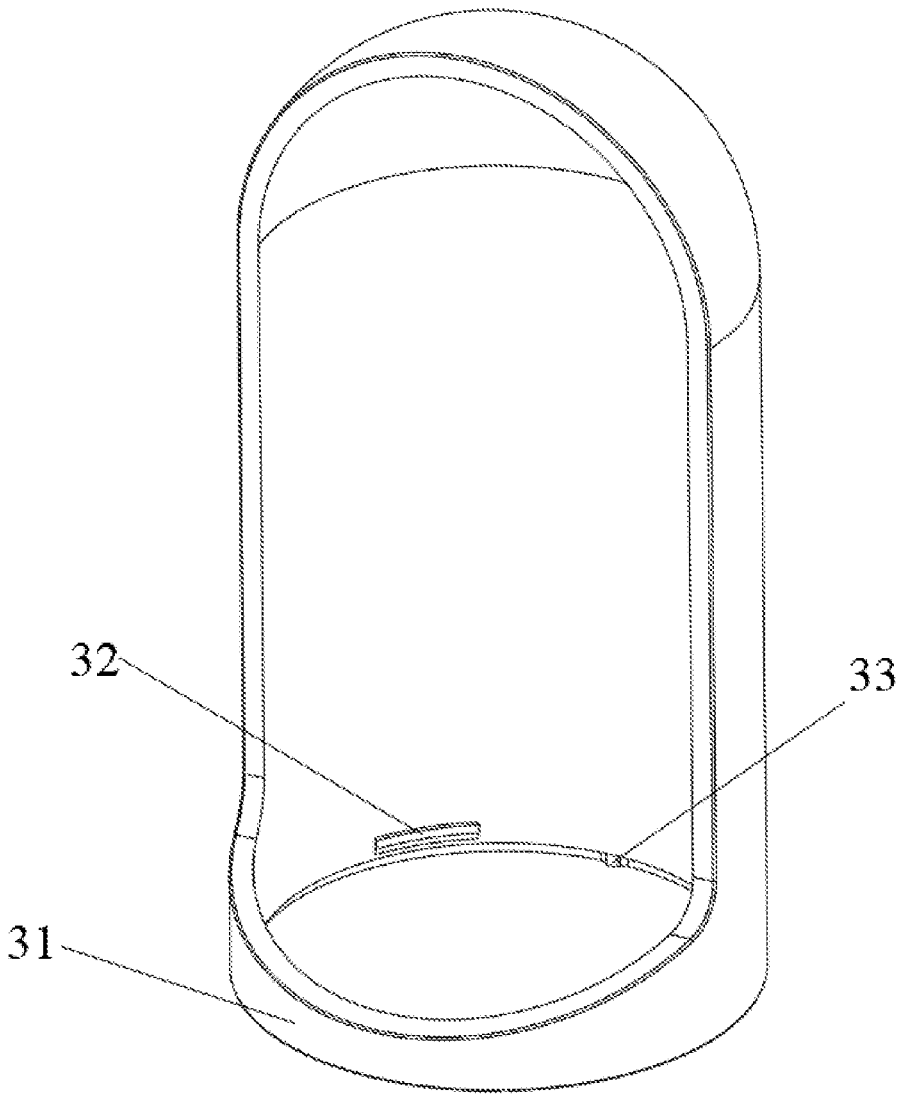
FIG. 4 is a schematic structural diagram of a protection cover of the utility model.

Further, referring to FIGS. 3 and 4, in this embodiment, the main housing 1 is opened and provided with an annular slot 121. The protection cover 3 is clamped and connected to the annular slot 121 via the catch platform 32 on the connecting part 31 so that the protection cover 3 is connected to the main housing 1. In addition, the catch platform 32 may be slid within the annular slot 121, which realizes the relative rotation between the protection cover 3 and the main housing 1, and complete the exposing and concealing of the fan blade 21.

Further, to ensure that when the protection cover 3 is opened, the fan blade 21 is completely exposed, and when the protection cover 3 is closed, the fan blade 21 is completely hidden, two limit grooves 122 for rotatably positioning the protection cover 3 are added in the annular groove 121. The two limit grooves 122 are stacked and provided along the rotating axial direction of the fan blade 21, respectively. The inner side of the connecting part 31 of the protection cover 3 is correspondingly added with the limit boss 33 adaptively clamped and connected to the limit groove 122 so that the protection cover 3 has two rotational positioning points. The two rotational positioning points correspondingly reveal the fan and hide the fan, which facilitates the user's operation, and improves the convenience of use.

Figure 6:
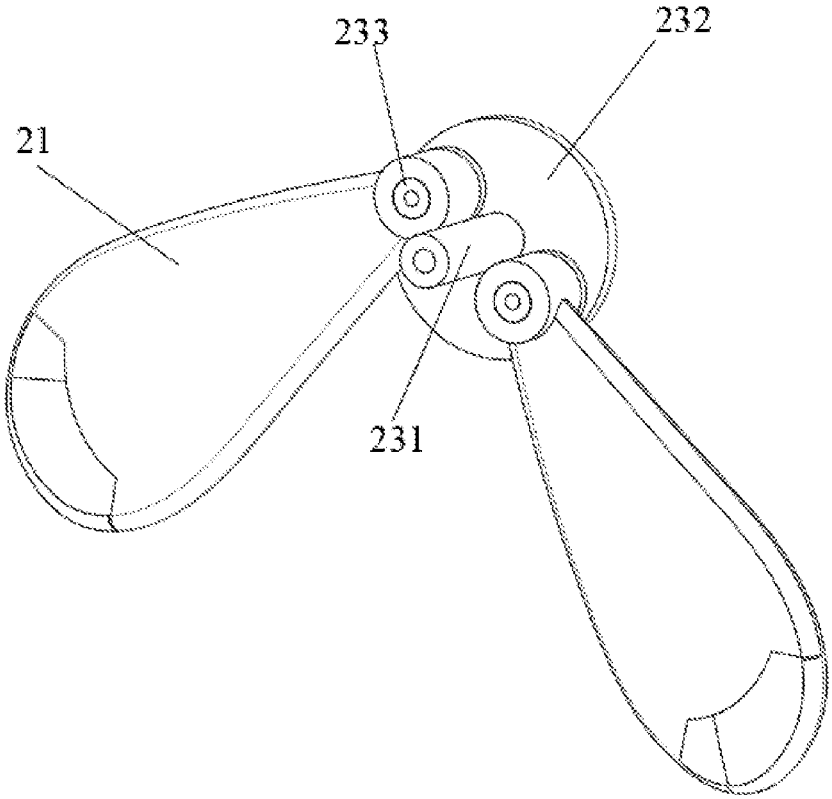
FIG. 6 is a schematic diagram of a mounting structure between a fan blade and a mounting member of the utility model.

Further, a drive shaft 221 of the motor 22 extends to an outer side of the mounting part 12. The drive shaft 221 is connected to a mounting member 23 for mounting the fan blade 21. Referring to FIG. 6, the mounting member 23 includes a connecting post 231 coaxially sleeved with the drive shaft 221. The connecting post 231 is provided with a mounting plate 232 at the end. The fan blade 21 is mounted on the mounting plate 232. In this embodiment, the fan blade 21 is connected to the drive shaft 221 of the motor 22 via one mounting member 23, which makes structural design simpler and the assembly easier. Specifically, the mounting plate 232 is provided as one circular plate, the mounting plate 232 is provided thereon with a plurality of mounting posts 233 for mounting the fan blade 21. The fan blade 21 is screwed to the mounting post 233 via a screw.

In this embodiment, the two mounting posts 233 are disclosed. The two corresponding fan blades 21 are also disclosed.

When being mounted, the two fan blades 21 are mounted on the mounting plate 232 respectively. Specifically, the mounting posts 233 of the mounting plate 232 are symmetrically arranged on the axis of the circular mounting plate 232. The end of the fan blade 21 is opened and provided with a cylindrical through groove, which is inserted into the mounting post 233, so that the fan blade 21 may be mounted on the mounting post 233. Further, to ensure the mounting stability of the fan blade 21, the end of the mounting post 233 may be opened and provided with a screw hole so that after the fan blade 21 is mounted on the mounting post 233, the fan blade 21 is pressed tightly by the screw so as to enhance mounting stability. Alternatively, the cylindrical through groove and the mounting post 233 may be glued and fixed, which is not restricted herein. Finally, the mounting member 23 with the fan blade 21 mounted is connected to the drive shaft 221 of the motor 22. It should be noted that the connecting post 231 of the mounting member 23 is opened and provided with a hole. The drive shaft 221 of the motor 22 is aligned with and inserted into the hole so that the connecting member is mounted on the drive shaft 221 of the motor 22. Similarly, the connecting post 231 and the drive shaft 221 of the motor 22 may be fixedly connected to each other by gluing and may be tightly fastened together by an interference fit, which is not limited herein.

Figure 5:
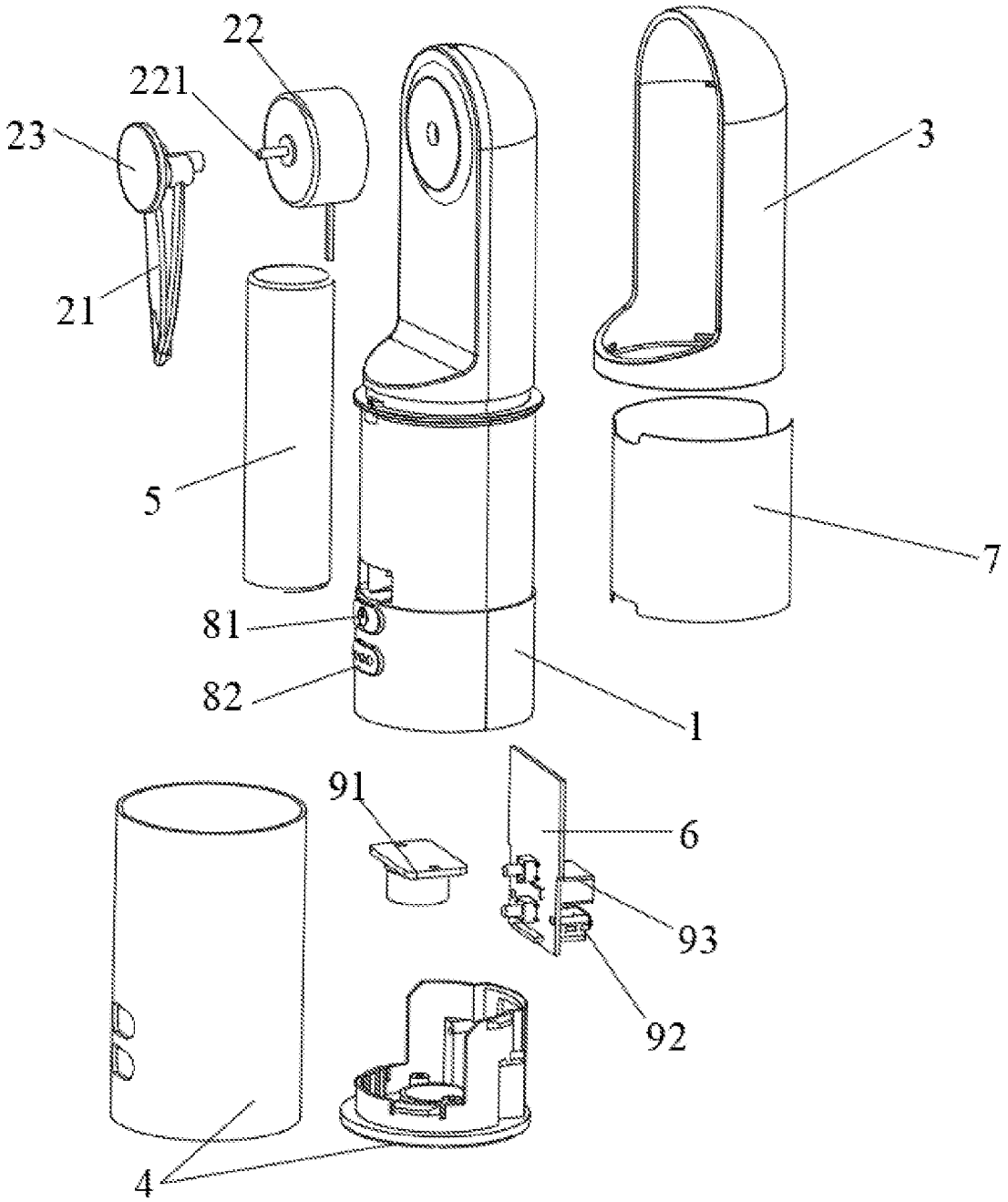
FIG. 5 is an explosive diagram of a structure of a fan of the utility model.

Further, referring to FIG. 5, the outer side of the holding part 11 is also wrapped with a layer of heating sheet 7. The heating sheet 7 is electrically connected to the PCB main control board 6 and the battery 5. In this embodiment, the battery 5 is controlled by the PCB main control board 6 to supply power to the heating sheet 7, so that the heating sheet 7 generates heat. The heating sheet 7 is tightly adhered to the bottom cover 4 outside of the holding part 11, so that the heat thereof can be transmitted to the bottom cover 4. When the user holds the bottom cover 4, the heat may be transmitted to a hand of the user, which plays a role of warming the hand.

Further, the side of the bottom cover 4 is provided with a first switch 81 for controlling the working state of the motor 22 and the heating sheet 7. The first switch 81 is electrically connected to the PCB main control board 6. It should be noted that the PCB main control board 6 is integrated with a control chip or a control circuit for processing and controlling a signal. The PCB main control board 6 is controlled so that the pressing operation of the first switch 81 may be converted into the switching of the working state of the motor 22 and the heating sheet 7. For example, the first switch 81 is pressed once to start the motor 22. The first switch 81 is pressed twice to start the heating sheet 7 to heat. The specific switching control principle is a conventional technical means in the art, which is not further repeated herein.

Further, an LED light 91 for illumination is also mounted at the end of the bottom cover 4. The LED 91 light is 5 electrically connected to the PCB main control board 6 and the battery 5. Similarly, the LED light 91 is added so that the hand-held fan has the function of illumination. In this embodiment, the side of the bottom cover 4 is also provided with a second switch 82 for controlling the working state of the LED light 91. The second switch 82 is electrically connected to the PCB main control board 6. The second switch 82 and the control circuit on the PCB main control board 6 may realize the on and off operation of the LED light 91. The switch control principle of the specific LED light 91 is a conventional technical means in the art, which is not repeated herein.

Further, the side of the bottom cover 4 is provided with a charging interface 92 for charging the battery 5. The charging interface 92 is electrically connected to the PCB main control board 6. In this embodiment, the charging interface 92 is provided as a type-c interface or lightning interface in the prior art, and no limitation is made herein. The battery 5 may be charged through the existing charging principle.

Further, the side of the bottom cover 4 is also provided with a USB interface 93 for charging an external device. The USB interface 93 is electrically connected to the PCB main control board 6. It should be noted that in this embodiment, charging and discharging circuits or chips may be integrated on the PCB control board, which can accomplish the function of the battery 5 inside the fan charging the external device via the USB interface 93. This principle is the charging principle for a portable mobile power supply in the prior art, which is the prior art, and is not repeated herein.

The foregoing is only a preferred embodiment of the utility model, and is not intended to limit the patent scope of the utility model. Under the concept of the utility model, an equivalent structure variation made by the contents of the description and drawings of the utility model or direct/indirect use of the utility model in other related arts is included in the scope of patent protection of the utility model.

What is claimed is:

1. A hand-held fan, comprising a main housing, wherein the main housing comprises a cylindrical holding part and a semi-cylindrical mounting part; wherein a fan blade for rotation is mounted at the mounting part, wherein a motor for driving the fan blade to rotate, a battery for supplying power to the motor, and a PCB main control board for controlling the motor to be turned on/off are mounted inside the main housing; and wherein the motor and the battery are electrically connected to the PCB main control board respectively;

wherein the hand-held fan further comprises a protection cover provided at the mounting part, wherein a main body of the protection cover is semi-cylindrical cover, and the protection cover is also provided with a connecting part rotatably connected to the mounting part, wherein an outer side of the mounting part is opened and provided with an annular slot, wherein the connecting part is provided with a plurality of catch platforms clamped and connected to the annular slot, wherein two limit grooves are symmetrically provided in the annular slot, and wherein an inner side of the connecting part is provided with two limit bosses clamped and connected to the two limit grooves;

wherein an outer side of the cylindrical holding part is wrapped with a layer of heating sheet, and the heating sheet is electrically connected to the PCB main control board and the battery.

2. The hand-held fan according to claim 1, wherein a drive shaft of the motor extends to the outer side of the mounting part, the drive shaft is connected to a mounting member for mounting the fan blade; the mounting member comprises a connecting post coaxially sleeved with the drive shaft, the connecting post is provided with a mounting plate at an end, and the fan blade is mounted on the mounting plate.

3. The hand-held fan according to claim 2, wherein the mounting plate is provided as a circular plate, the mounting plate is provided thereon with a mounting post for mounting the fan blade, and the fan blade is fixed at the mounting post by a screw.

4. The hand-held fan according to claim 1, wherein the outer side of the cylindrical holding part is also sleeved with a bottom cover, and the heating sheet is mounted in close proximity to an inner side of the bottom cover.

5. The hand-held fan according to claim 4, wherein a side of the bottom cover is provided with a first switch for controlling a working state of the motor and the heating sheet, and the first switch is electrically connected to the PCB main control board.

6. The hand-held fan according to claim 5, wherein an LED light for illumination is also mounted at an end of the bottom cover, and the LED light is electrically connected to the PCB main control board and the battery.

7. The hand-held fan according to claim 6, wherein the side of the bottom cover is also provided with a second switch for controlling a working state of the LED light, and the second switch is electrically connected to the PCB main control board.

8. The hand-held fan according to claim 5, wherein the side of the bottom cover is provided with a charging interface for charging the battery, and the charging interface is electrically connected to the PCB main control board.

9. The hand-held fan according to claim 5, wherein the side of the bottom cover is also provided with a USB interface for charging an external device, and the USB interface is electrically connected to the PCB main control board.

* * * * *